US005715634A

United States Patent [19]

Schultz

[11] Patent Number: 5,715,634

[45] Date of Patent: Feb. 10, 1998

[54] SKYLIGHT CONSTRUCTION

[75] Inventor: Hans Schultz, Arlington Heights, Ill.

[73] Assignee: SPS Corporation, San Jose, Calif.

[21] Appl. No.: 484,553

[22] Filed: Jun. 7, 1995

[51] Int. Cl.[6] ..... E04B 7/18

[52] U.S. Cl. ..... 52/200; 52/745.06

[58] Field of Search ..... 52/200, 202, 745.06, 52/DIG. 17

[56] References Cited

U.S. PATENT DOCUMENTS

| | | | |
|---|---|---|---|
| 3,844,086 | 10/1974 | Radtke | 52/669 X |
| 4,843,787 | 7/1989 | Pierson | 52/209 X |
| 4,977,716 | 12/1990 | Hawkins | 22/209 X |
| 5,007,215 | 4/1991 | Minter | 52/DIG. 17 X |
| 5,092,087 | 3/1992 | Kane et al. | 52/209 X |
| 5,394,666 | 3/1995 | Zahner | 52/745.05 X |

*Primary Examiner*—Carl D. Friedman
*Assistant Examiner*—Beth A. Aubrey
*Attorney, Agent, or Firm*—Fitch, Even, Tabin & Flannery

[57] ABSTRACT

An existing glazing system using small rectangular plastic or glass glazing panels or using thin films, plastic glazing panels may be converted in an inexpensive manner to an elongated rigid, plastic glazing panel system having a condensate removal system. Very long glazing panels of plastic, preferably corrugated, are laid across several purlins in the vertical direction. The glass glazing panels or the thin film glazing panels are removed to expose the roof members. Purlins are laid across the roof members with ends of the purlins positioned intermediately adjacent roof rafters. Condensate collector channels on the purlins convey moisture to the ends of the purlins and discharge collected moisture to an underlying drain, which is fastened to and carried by the purlins. The drain is spaced from the rafter roof members. Very long glazing panels of plastic, preferably corrugated, are laid across several purlins in the vertical direction. Because the rigid, plastic glazing panels have edges that are located intermediate the roof rafters, the width of the rigid, plastic glazing panels need not be sized to match the width of the spacing between adjacent roof rafters. The drains are located in a plane beneath the plane defined by upper surfaces of the roof rafters. In another embodiment, the purlins are attached to and spaced above roof purlins by spacers to locate the drains above the roof purlins.

17 Claims, 16 Drawing Sheets

SKYLIGHT CONSTRUCTION

This invention relates to structures of which at least a glazing panel section transmits light.

BACKGROUND OF THE INVENTION

The present invention is directed to a method of making glazing panel systems and is of particular usefulness in converting existing skylight structures, such as used in various buildings (e.g., enclosed swimming pools, solariums, greenhouses, etc.) to a different glazing panel system. The invention will be described in connection with greenhouses although the invention is not limited to greenhouses and can be used in various other kinds of buildings with glazing panels or thin plastic glazing therein. Such building structures often have small rectangular, glazing panels of glass or rigid plastic or long sheets of thin plastic films; and it is often desired to replace these plastic film or glazing panels with large, rigid, plastic sheets or panels that are very long and often corrugated panels of plastic. The most inexpensive greenhouses are built using very large sheets of plastic film laid over pipes or other frameworks, which serve as bowed rafters to support the plastic film. In some instances, the pipes are bowed into an arc to form a Quonset hut frame onto which thin, film sheets are laid to form the greenhouse. Such Quonset appearing greenhouses have a number of shortcomings, one of which is that they usually do not have a condensate drainage removal system that collects and drains away condensation forming on the inside of the plastic film sheets.

Most importantly, the thin film, plastic sheets last only several years, e.g., three (3) years before they degrade and deteriorate, such as discoloring or becoming brittle, to the point that they must be replaced. These plastic films come in very large sheets and are flimsy and are not rigid. The replacement of this deteriorated, film glazing material is a dreaded task because of cost in the first instance; and now, in the second instance, even more dreaded because the plastic film presents an environmental problem of how to dispose of it. The film is usually treated to be nonflammable, so it cannot be easily burned. Also, some large growers may have acres and acres covered with such plastic film; and hence, have a large disposal problem.

Today, a much preferred glazing material to these thin plastic films, except from an original installation price standpoint, is an elongated rigid panel of polycarbonate, or the like, that is transparent and thicker than a film and is usually corrugated to provide more rigidity thereto. An example of such a rigid glazing panel is sold under the trademark DYNAGLAS® by Specialty Products Corporation of San Jose, Cali. These glazing panels are very light in weight compared to glass glazing panels; and they have a life of twenty-five (25) years or more compared to three-year life of plastic films. These rigid panels come in standard widths, e.g., 48 inches and long lengths (e.g., up to thirty-nine feet in length).

It is a particularly difficult problem to replace in an inexpensive manner, the thin plastic film in greenhouses with the elongated rigid, plastic panels with a condensation removal system, which is characteristic of more expensive greenhouses having a conventional purlin and rafter condensation removal system. Heretofore, it has been suggested to lay purlins across the bowed rafters to form a rectangular grid and to insert rectangular-shaped, rigid panels of polycarbonate or the like into the grid much in the manner of glass panels. But this suggestion does not provide a condensation removal system.

Other greenhouses use glass glazing panels and owners of these greenhouses often would like to convert these glazing panels to rigid polycarbonate, glazing panels. Glass panels are a problem for a grower when he has to replace the glass panels. First, the grower must scrape out the old sealant which can be a difficult chore. Also, the roof rafters are often deteriorated and the owner needs to clean them and paint them because they will be exposed to the elements. It is difficult and dangerous to reglaze a greenhouse with glass panels, which panels must be embedded in a new sealant. Glass breakage presents a product liability and safety problem in that workers can be cut on broken glass and in positioning glass panels high upon a structural roof. The spacing between adjacent, glass glazing rafters is often quite small, e.g., 16 to 20 inches being typical; and in some instances, the glass may be 24 inches wide. Thus, a large number of rafters are often employed to carry the glass thereon. The glass glazing panel sizes are usually 16"×20", 20"×20", and 24"×24". When converting from a glass panel glazing system to an elongated, plastic panel glazing system, every other rafter may be removed to allow more light into the greenhouse. In some instances, for example, where the rafters are only sixteen (16) inches apart, two adjacent rafters are removed, rather than only one rafter in order to give more light. Then, the lightweight, rigid plastic panels are placed on the rafters. In some greenhouses, the roof purlins are the only supporting structure for the elongated plastic, glazing panels, and they are secured to the roof purlins.

When glass glazing panels in greenhouses are being replaced with the rigid plastic panels, a problem that frequently arises is that the spacing between rafters varies considerably from one greenhouse to the next greenhouse. Because the greenhouses were often built by the owners and not to any particular standards, this wide variation in rafter spacing makes it difficult to align the edges of the new rigid, plastic panels with rafters. Further, people who stock and carry an inventory of the long rigid, plastic panels used as replacements for the glass panels only want to inventory one or two widths of long panels rather than numerous odd panel widths. Stated differently, distributors or retailers will not carry large numbers of panel widths to meet each of the space variations between rafters used in old glass greenhouses.

In order to provide existing greenhouses with a purlin and rafter condensation removal system at the time of conversion to a rigid, plastic panel system, it was necessary heretofore to raise or lift the purlins relative to the rafters so that water flowing laterally along a purlin condensation collector channel could drop downwardly into a downwardly, extending rafter condensation drain than carries the moisture downwardly to a disposal point.

Thus, there is a need for a new and improved system for converting existing greenhouses to rigid, plastic panels, and also to provide them with an inexpensive, condensation removal system.

SUMMARY OF THE INVENTION

In accordance with the present invention, an existing greenhouse having glass or other small, rigid glazing panels or having a thin film glazing material may be converted to the use of rigid, plastic glazing panels that are thin, lightweight and quite long. The method of doing such a conversion comprises the steps of removing the old glazing material and exposing the rafters and/or roof purlins. A condensate removal system is obtained by placing new condensate purlins across the roof rafters (or roof purlins) and having ends of the purlins disposed in the space intermediate the rafters. The adjacent ends of the purlins are spaced to allow condensate to discharge from condensate collector channels on the purlins into a drain located beneath the ends of the purlins. The drains may be located in a plane below a plane defined by the top surfaces of the rafters. The drain may be secured by fasteners to the undersides of the purlin ends to span the space therebetween. Preferably, adjacent and aligned purlin ends are spliced together at locations intermediate the rafters to provide a continuous purlin between adjacent set of rafters. The glazing panels are laid on the purlins and are secured thereto. If there is a vent, the upper ends of the glazing panels may be bent downwardly and secured to a lower flange on the adjacent purlin, leaving the upper edge of the purlin free to seal with a vent wing. The preferred plastic, glazing panels are corrugated, transparent sheets of polycarbonate or the like. These glazing panel sheets are overlapped at longitudinal edges at locations between rafters so the width of these panel sheets need not be sized to the spacing between rafters.

In another form of the invention where roof purlins rather than roof rafters are the primary roof support structure for the old glazing panels, the new condensate purlins are fastened to the tops of the roof purlins with spacers therebetween to raise the elongated glazing panels. This allows drains to pass over the roof rafters. The ends of the purlins are spaced from the rafters.

Also, in accordance with the invention, there is provided a new and improved skylight structure having long, rigid plastic glazing panels that have longitudinal edges meeting at locations between rafters. Long purlins span several rafters and are spliced together. Elongated drains are located beneath several aligned splices to receive condensate from several purlins and to convey away the condensate. The drains are fastened to the purlins.

DETAILED DESCRIPTION OF PREFERRED EMBODIMENTS

Figure 1:
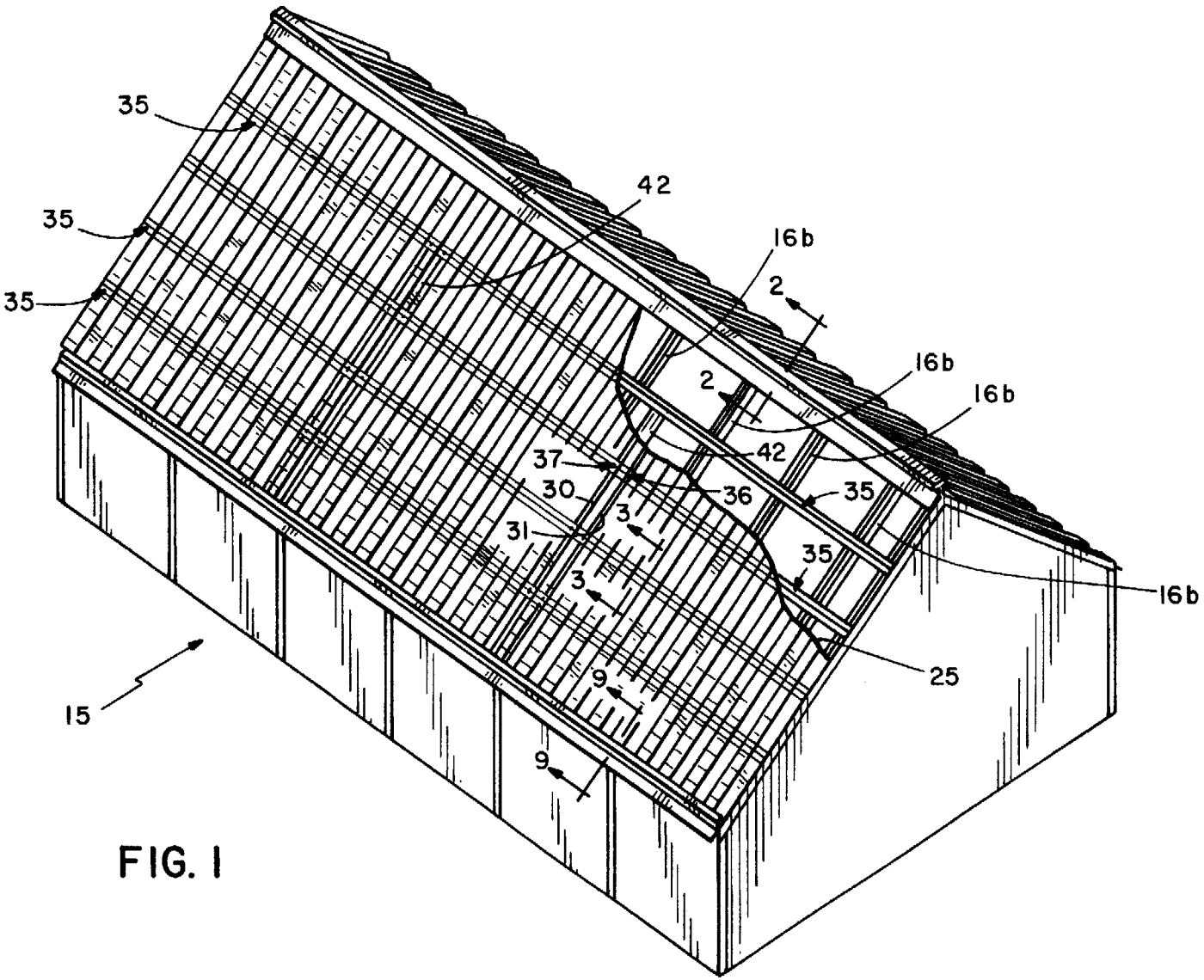
FIG. 1 is a perspective view of a skylight structure in which the present invention is embodied.
Figure 1A:
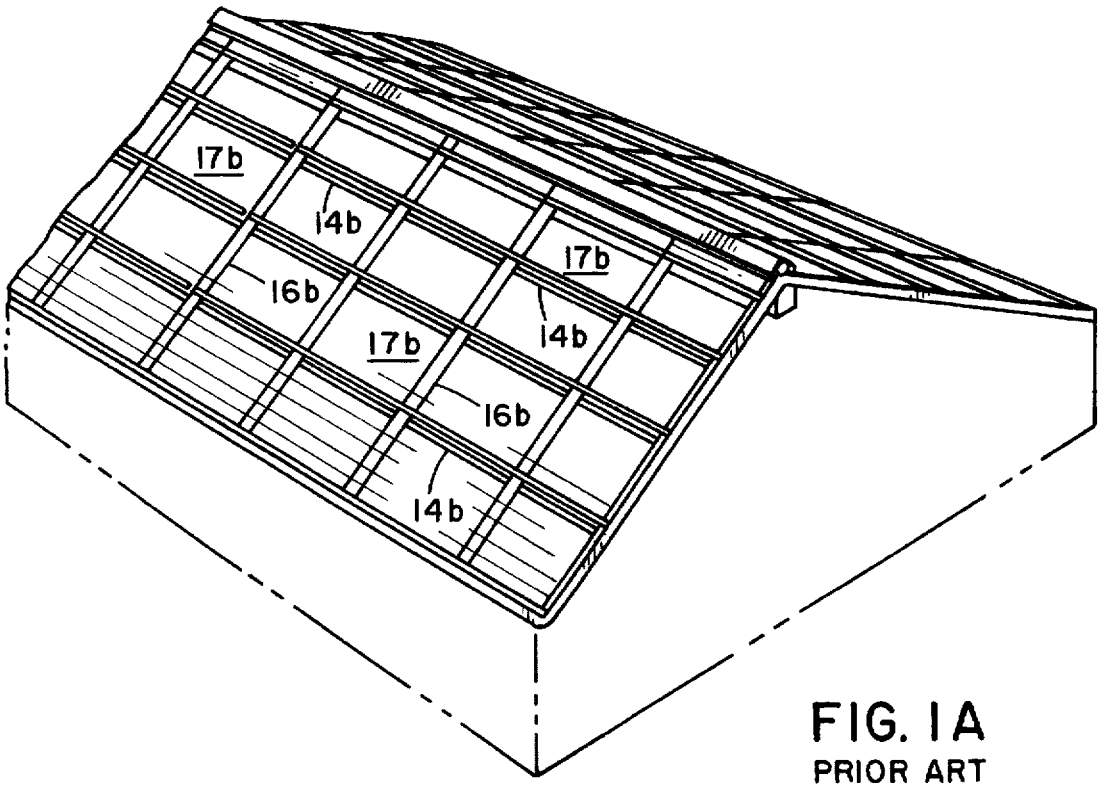
FIG. 1A PRIOR ART
FIG. 1A is a perspective view of greenhouse of the prior art having glass glazing panels.

One form of conventional skylight structure used in greenhouses or the like uses rectangular sheets of glass supported along the four (4) edges thereof, by vertically-inclined rafters **16*b* and horizontally-extending purlins 14*b* (FIG. 1A). Often, the skylight structure constitutes the entire sloping or pitched roof of the building. Alternatively, a skylight structure can constitute only a portion of a building. Often, the rafters 16*b* and cross-crossing purlins 14*b*** are made of a metal extrusions, such as aluminum, with the ends of the purlins projecting onto and carried by the rafters, (See U.S. Pat. No. 3,844,086, to form a rigid grid structure.) Such grid structures formed of rafter members and interlocking purlin members are well known in the construction art. However, the rafters and purlin members can be made of wood or materials other than metal and can be other than tubular in configuration.

Spacing of the rafters 16b can vary but a spacing of 16", 20" or 24" in glass greenhouses is fairly typical. The rafters slope upwardly and extend over the entire span of the skylight. The cross-crossing purlins 14b extend horizontally in a direction generally perpendicular or normal to the rafters and are connected thereto by suitable means, such as by interlocking engagement, or by pins, nuts and bolts or the like. The rafters and purlins, because of weigh considerations, are preferably, but not necessarily, formed of lightweight material such as extruded aluminum. The rafters and purlins when assembled and joined form a grid or skeleton framework for supporting light-transmitting, glass or rigid, rectangular plastic glazing panels 17b.

The glass panels 17b are a problem for a grower in that they require maintenance and are expensive to replace. Each glass glazing panel, which are typically 6"×16", 20"×20" or 24"×24", is embedded in a sealant which must be scraped out and replaced with a new sealant. A further problem with glass panels is that when they become broken and need to be replaced, that they are dangerous because people can be cut seriously when replacing glass at considerably heights in the air. In some instances, the rafters and purlins may have an existing condensation removal system; but in many cases, they do not.

A further problem is that the rafter spacing in old greenhouses varies substantially because the skylight structure was often made by the owner or by a local contractor using non-standard spacing between rafters. If one intends to place lightweight, elongated, glazing panels of rigid plastic on the glass glazing rafters with the panel edges meeting at and supported on adjacent rafters, one would have to stock or cut sheets to each of the various widths needed for the various rafter spacings. Cutting of the edges of larger widths of rigid glazing panels to six is expensive and wasteful. Dealers will not stock and manufacturers will not produce a large number of such custom widths to match the various glass glazing rafter spacings encountered.

Figure 1B:
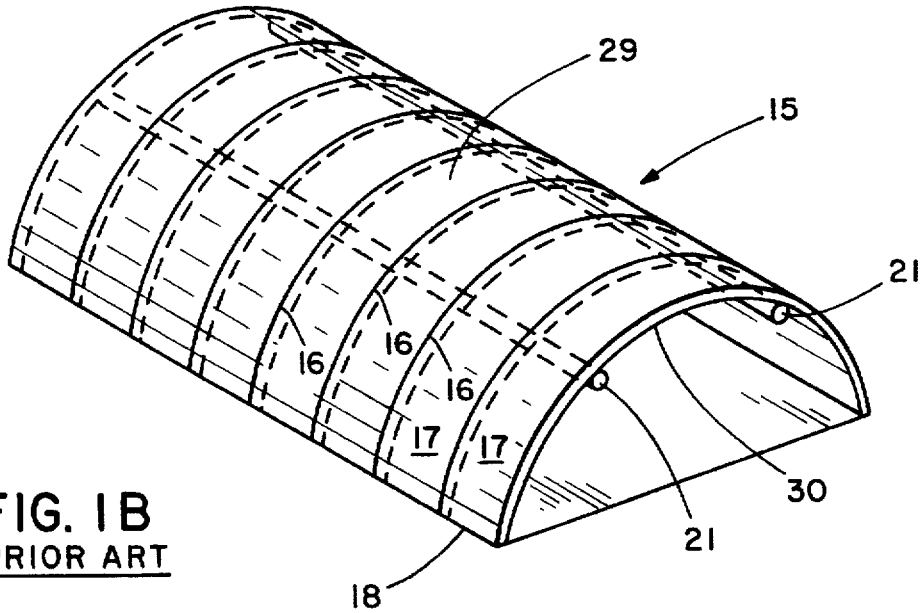
FIG. 1B PRIOR ART
FIG. 1B is a perspective view of a greenhouse of the prior art having thin, plastic film, glazing panels.

In another form of greenhouse 15, such as shown in FIG. 1B, shaped like a Quonset hut, the rafters 16 are made of bowed pieces of pipe that are generally semi-circular hereinafter called "roof bow rafters" 16. Usually, very large sheets of plastic film 17 are wrapped in one large continuous sheet or web from a lower edge 18 on one side across the top crown 29 of the greenhouse to an opposite lower edge 19. This plastic film deteriorates in several years and becomes discolored and may tear. Usually, these Quonset hut greenhouses lack any condensation removal system. Currently, there is no cost-effective method or system to convert these systems to the use of elongated rigid, plastic glazing panels with a condensation removal system. Typically, these Quonset hut systems lack the transverse purlins between rafters to form the grid of purlins and rafters, such as illustrated in FIG. 1A to support glass glazing panels 17b. In this Quonset hut greenhouse, cross pipes or members 21 (FIGS. 1B and 1C) are connected to the underside of the roof bow rafters 16 to stabilize the rafters but are spaced too low beneath the thin, plastic film to provide support for the plastic film. The cross pipes 21 are part of a building structure 15, and are not part of a glazing system for the building structure.

Figure 2:
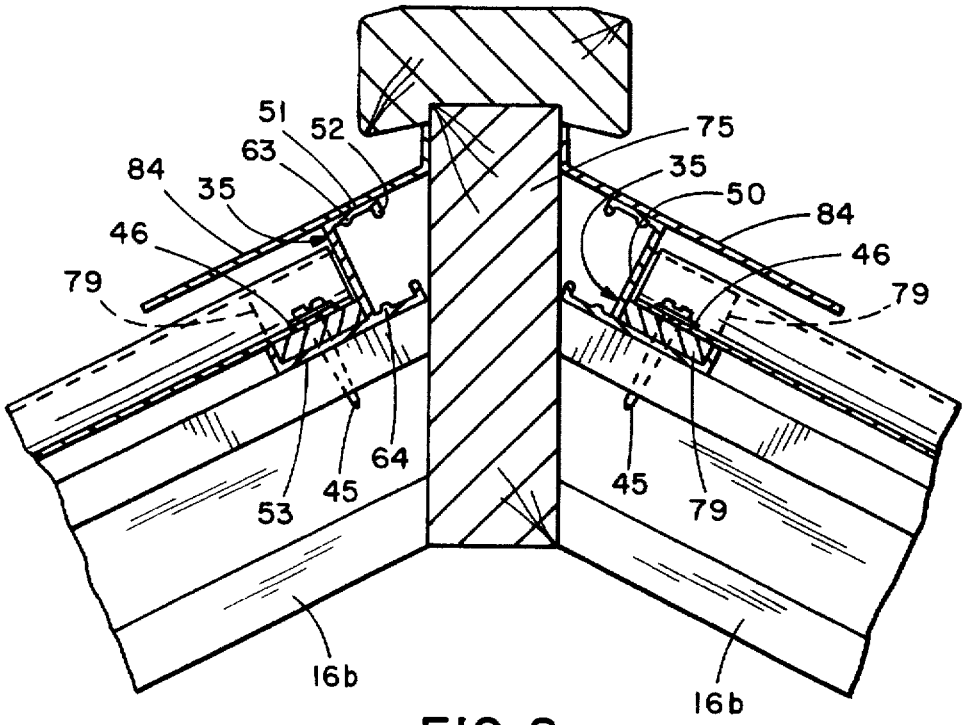
FIG. 2 is a cross-sectional view of a typical existing wood rafter-to-ridge detail showing glazing panels fastened to the top purlin with the addition of a metal cap member.
Figure 2A:
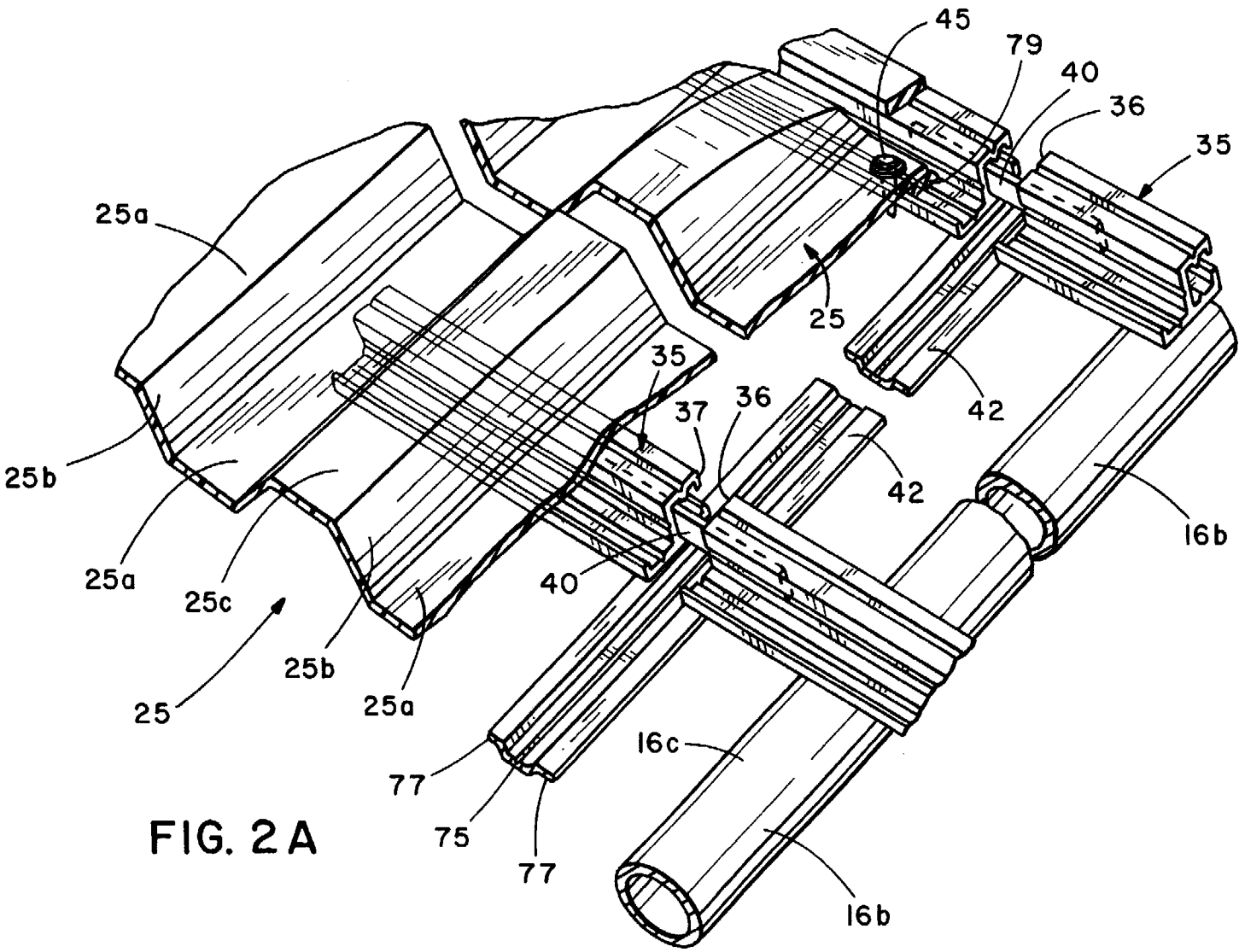
FIG. 2A is a fragmentary, diagrammatic exploded view illustrating perpendicularly disposed rafters and purlins supporting glazing panels of rigid plastic.

Another glazing panel material is that shown in cross-section in FIG. 2A is an elongated rigid, plastic sheet that is usually in the range of about 0._ to 0.31 inch in thickness and weighs about 0.25 lbs. per square foot for a glazing panel 25. The maximum panel length is 39 feet and widest width is 48 inches, for the illustrated panels 25. The preferred and illustrated glazing panel 25 is sold under the trademark DYNAGLAS® and is corrugated with channels defined by a bottom flat wall 25a, sloped sidewalls 25b, and a top flat wall 25c. Many greenhouse growers want to convert their small rectangular, rigid, plastic glazing panels, their glass glazing panels 17b (FIG. 1A) or their thin plastic films 17 to these elongated rigid, plastic glazing panels 25.

Figure 6:
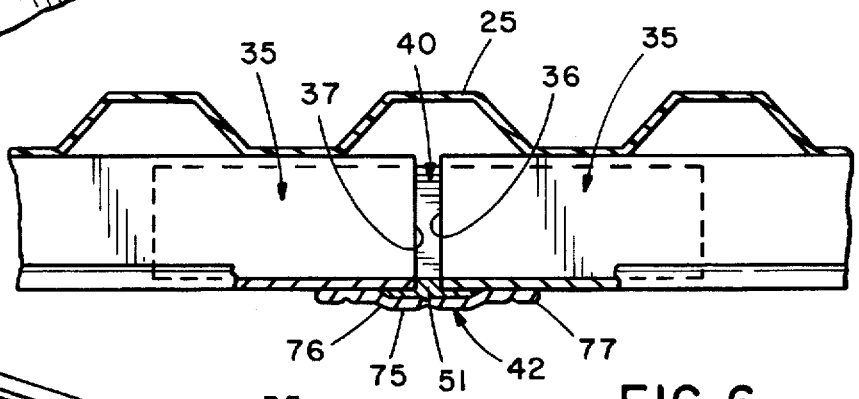
FIG. 6 is a cross-sectional view taken along the line 6—6 of FIG. 5.
Figure 7:
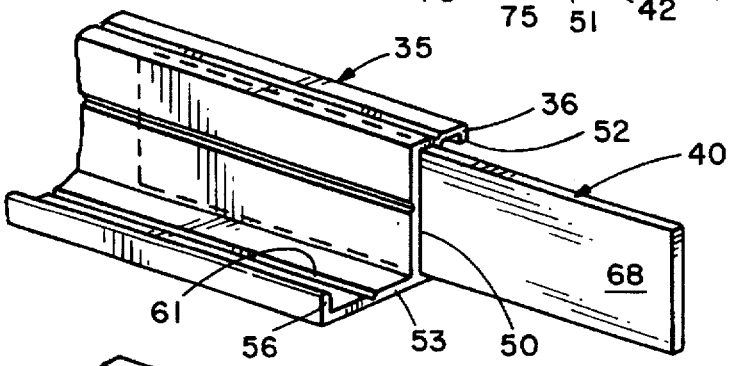
FIG. 7 is a perspective view of a purlin and a splice.
Figure 8:
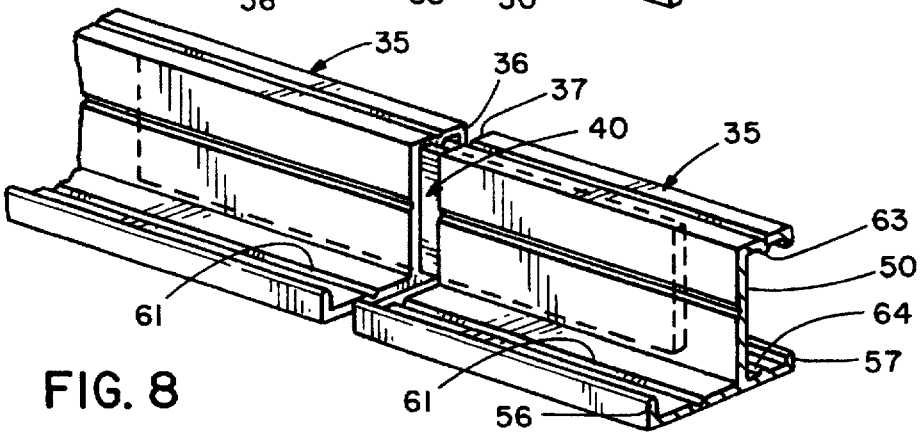
FIG. 8 is a view of two purlins joined by a splice bar.

In accordance with the present invention, the glass glazing panels 17b or thin film sheets 17 are replaced with elongated rigid, plastic glazing panels 25 in long sheets, e.g. 48 inches in width and twelve to thirty-nine feet in length; and a condensation removal system 26 is provided in an inexpensive manner. The rigid, plastic glazing panels 25 may be in a standard width, e.g., forty-eight inches in width, even though the rafter centerline-to-centerline spacing may be an odd dimension such as nineteen inches. Preferably, the internal, lateral edges 30 and 31 (FIG. 3A) of the adjacent, rigid, plastic glazing panels 25 are brought together at locations intermediate the rafters 16 or 16a where the rafters are present. In some instances, it may be possible to remove all rafters leaving on the roof purlins 14b. In most instances, only ever other glazing glass panels rafter 16b is removed. Also, adjacent purlins 35 may have their internal aligned ends 36 and 37 spaced from one another. The longitudinal edges 30 and 31 of the elongated glazing panels 25 may be overlapped. Preferably, the purlin ends 36 and 37 are spliced together with simple splice means in the form of splice bars or plates 40 (FIGS. 6, 7 and 8). As best seen in FIG. 3A, the condensation collected by the collectors or purlins flows horizontally along the purlins to their spaced ends 36 and 37 and discharges down at this space into a lightweight, small drain 42 that conveys the condensation downwardly from the purlins. The condensation drains 42 are preferably spaced intermediate and are disposed parallel to the roof rafters 16 or 16a.

Figure 18:
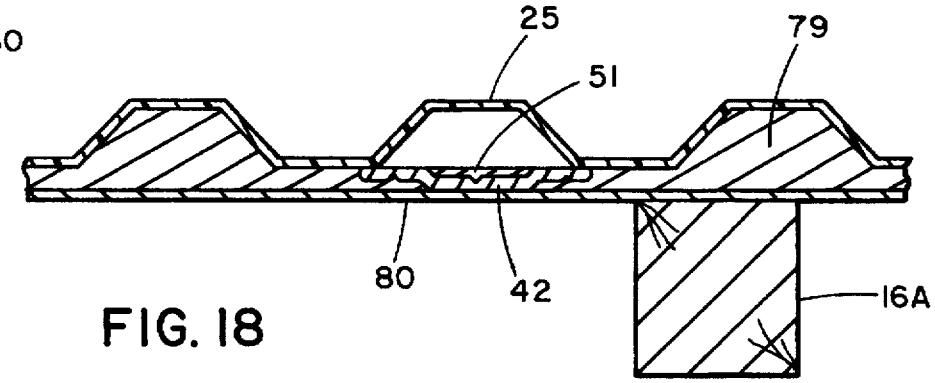
FIG. 18 is a cross-sectional view showing a drain, glazing panel and purlin, taken along line 18—18 of FIG. 17.
Figure 19:
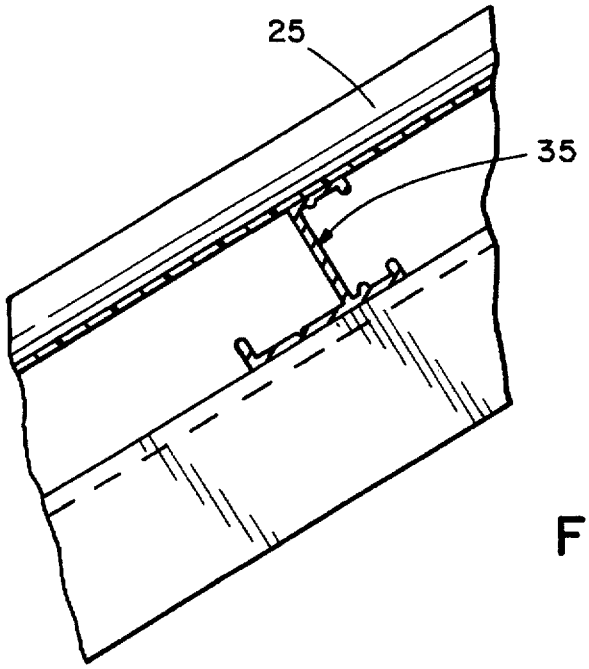
FIG. 19 is a cross-sectional view of a purlin supporting a glazing panel on a rafter.
Figure 21:
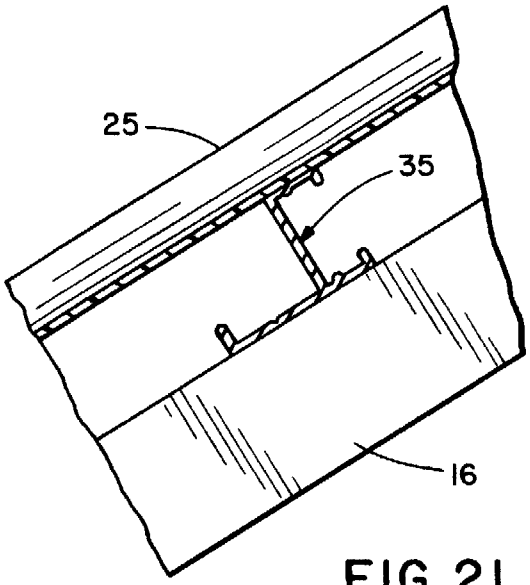
FIG. 21 is an enlarged, cross-sectional view taken along the line 21—21 in FIG. 20.
Figure 20:
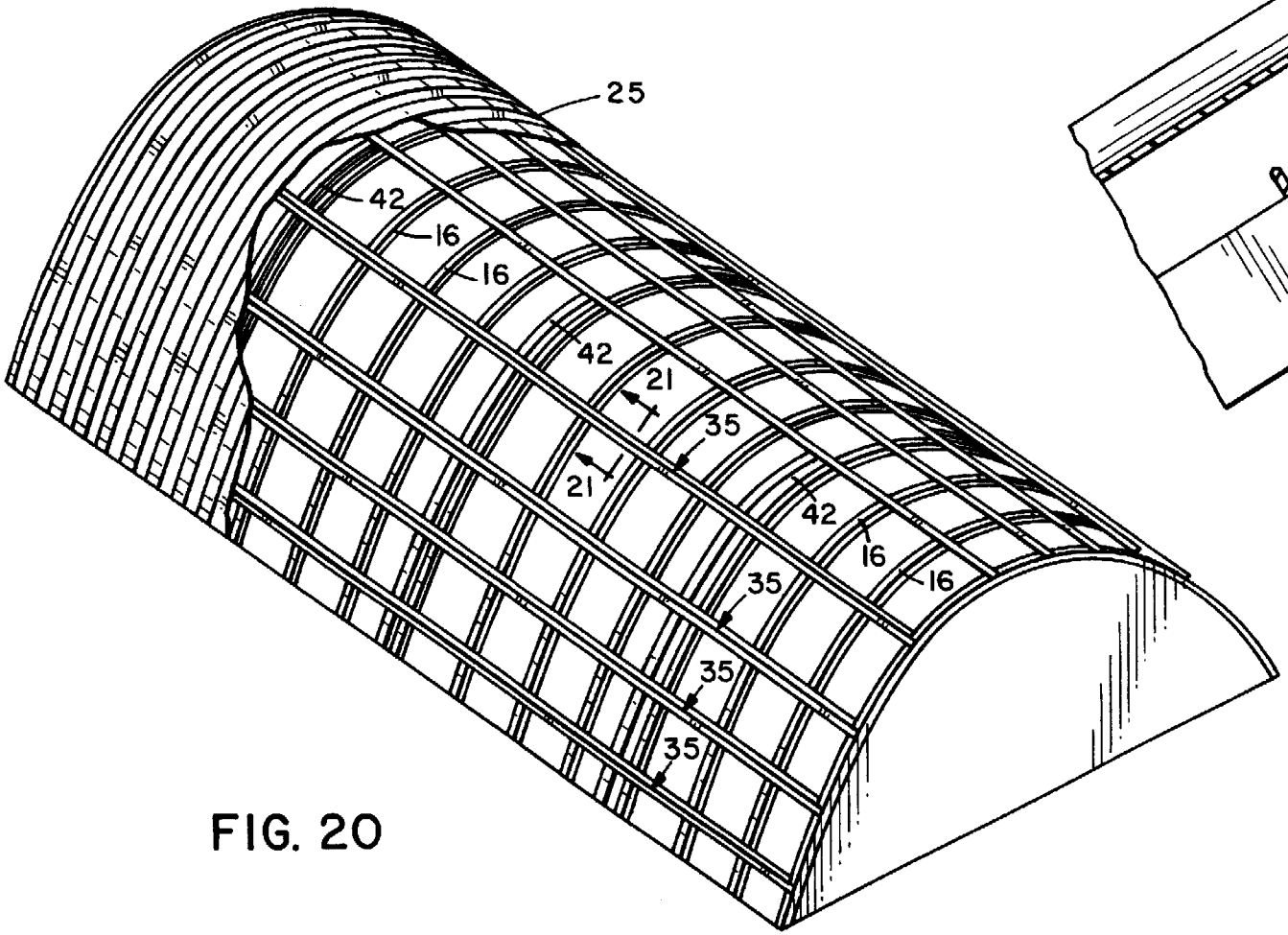
FIG. 20 illustrates a Quonset structure embodying the glazing system of the present invention.
Figure 22:
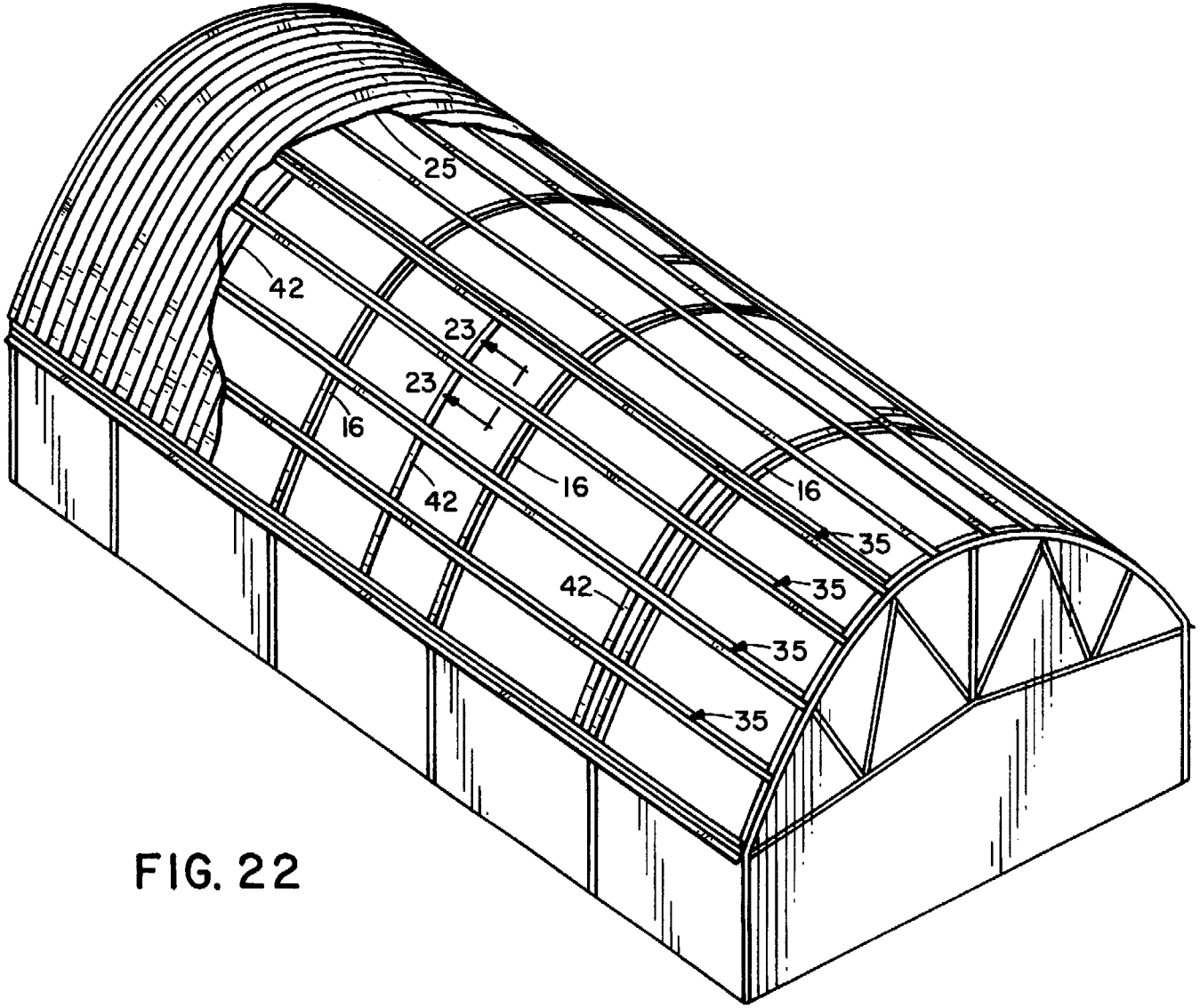
FIG. 22 is a view of a curved roof structure embodying the glazing system of the present invention.
Figure 23:
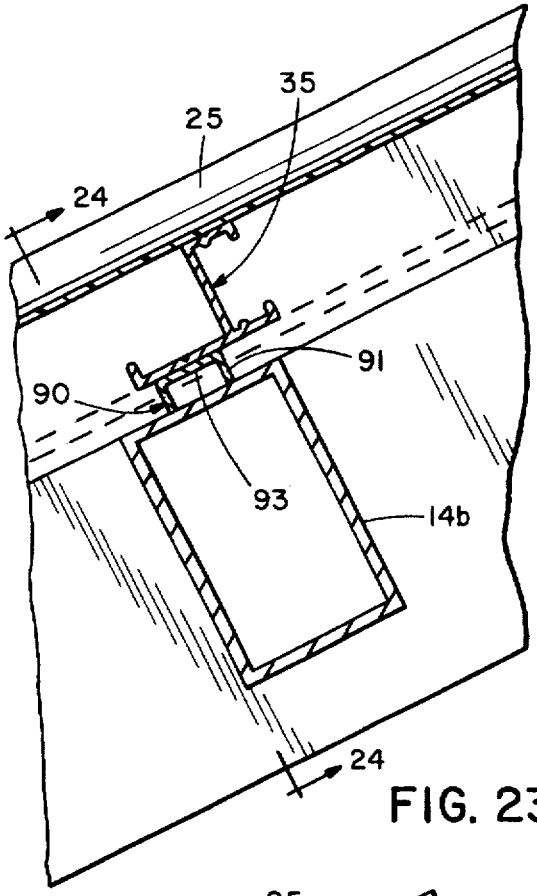
FIG. 23 is a cross-sectional view taken along the line 23—23 in FIG. 22.
Figure 24:
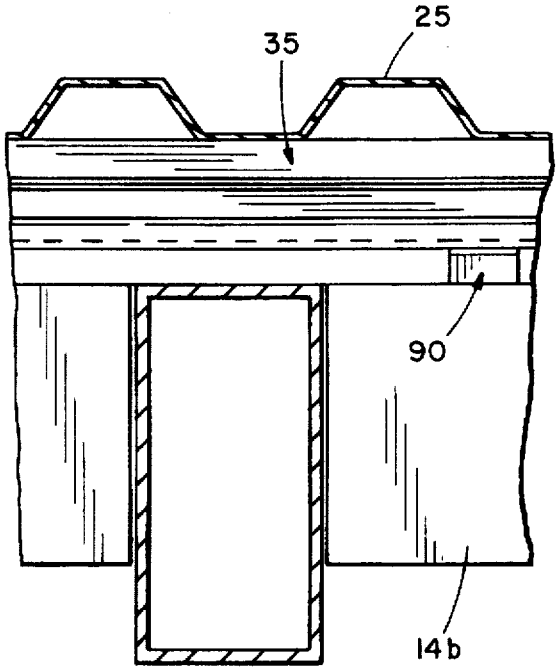
FIG. 24 is a cross-sectional view taken along the line 24—24 in FIG. 23.
Figure 25:
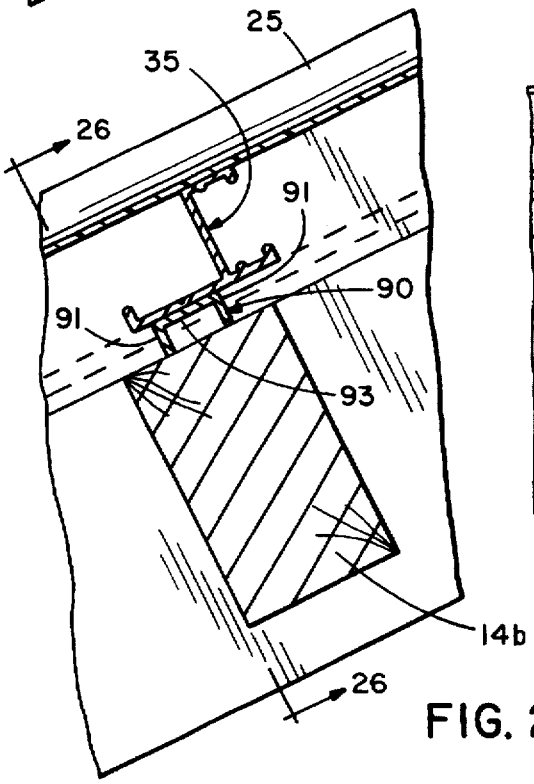
FIG. 25 illustrates a purlin mounted by a spacer on a wood roof purlin.
Figure 26:
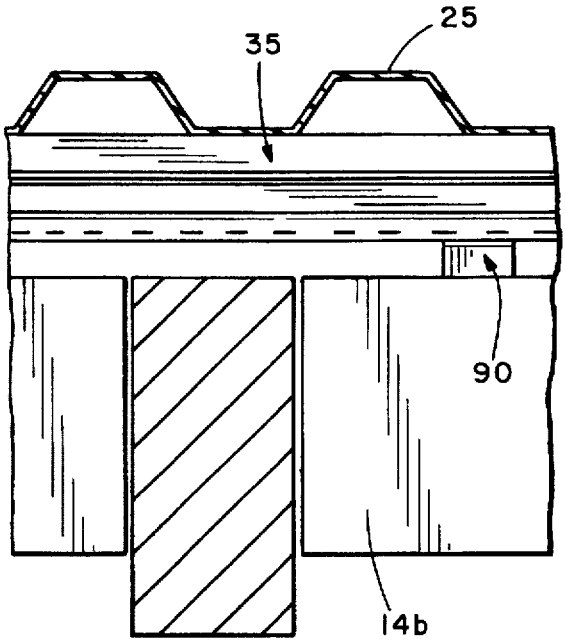
FIG. 26 is a cross-sectional view taken along the line 26—26 of FIG. 25.
Figure 27:
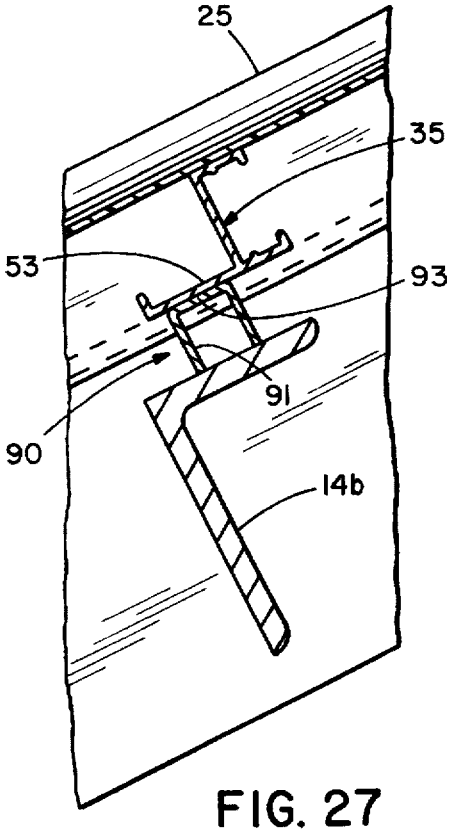
FIG. 27 is a view showing a purlin mounted by a spacer on an angle roof purlin.
Figure 28:
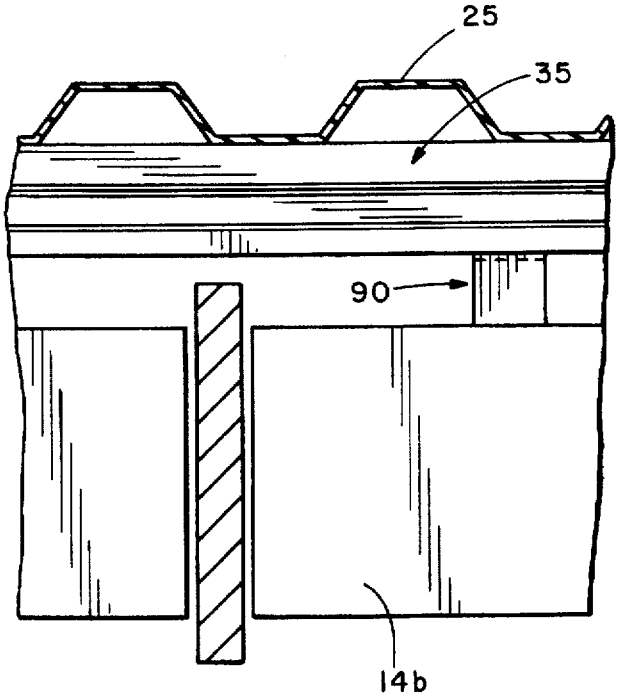
FIG. 28 is a cross-sectional view of the roof of FIG. 27.
Figure 29:
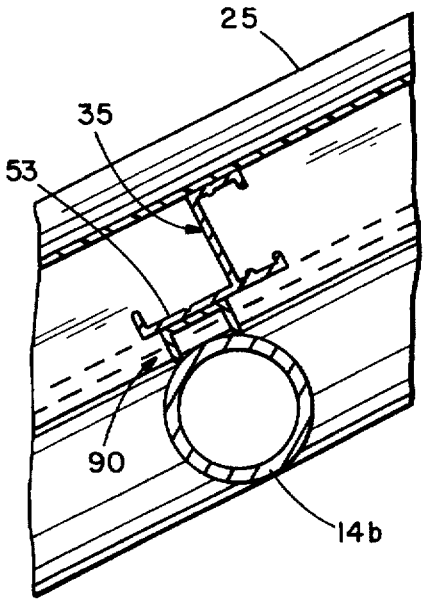
FIG. 29 is a view similar to FIG. 27 having a tubular purlin.
Figure 30:
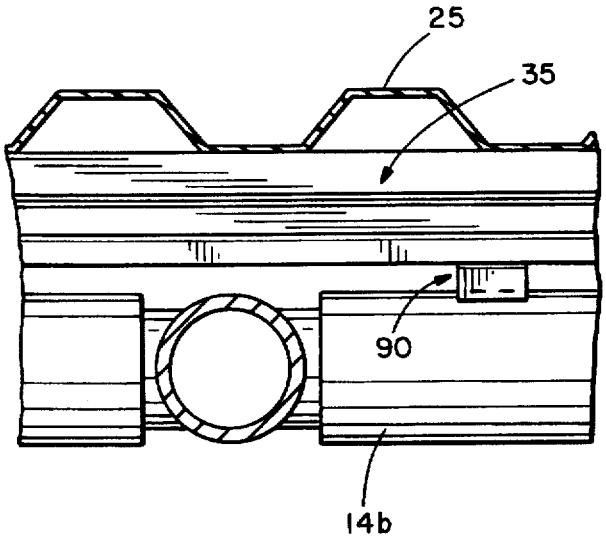
FIG. 30 is a view similar to FIG. 28 having a tubular rafter.
Figure 31:
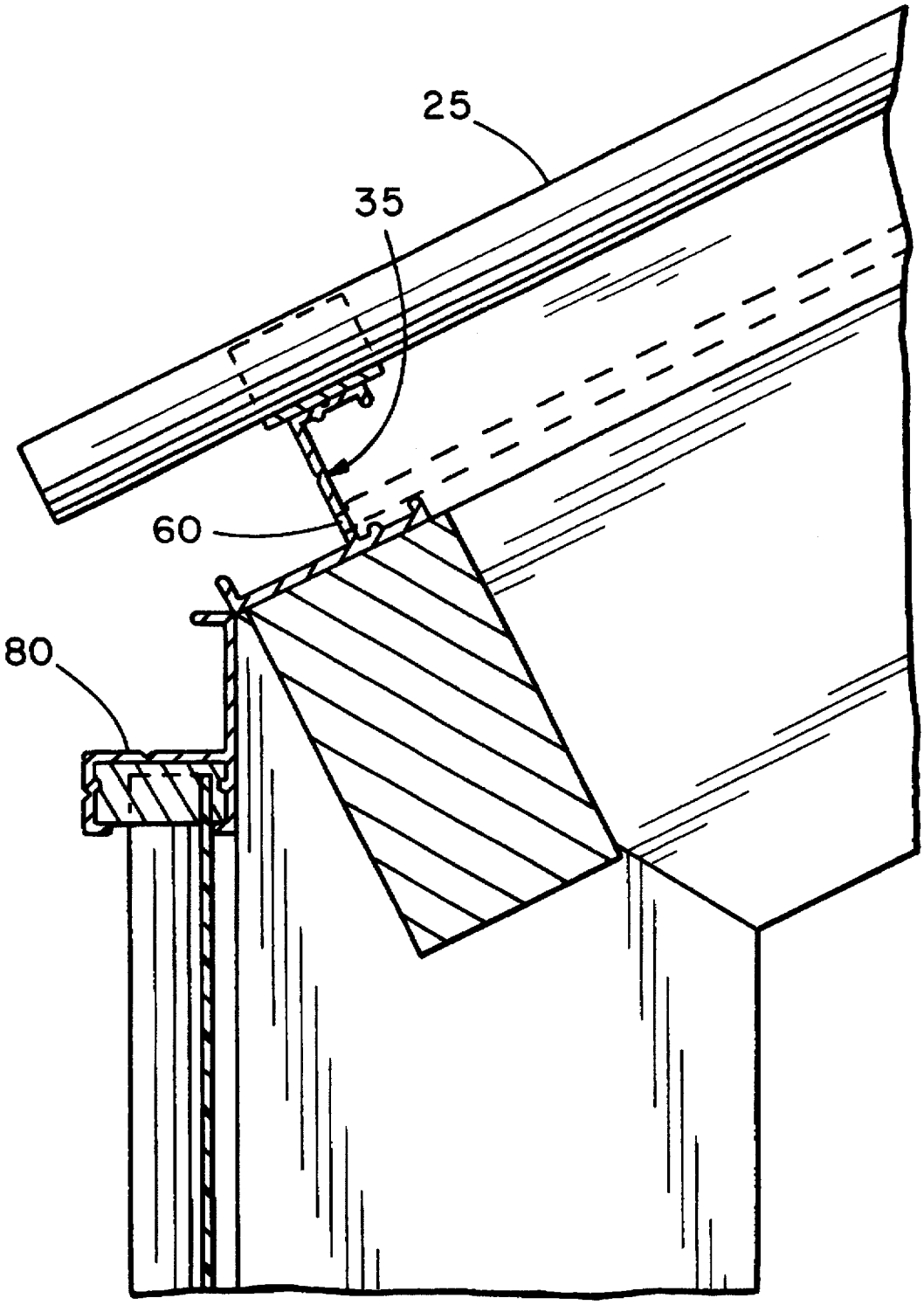
FIG. 31 is a view illustrating a drain discharging at an eave.

According to the method of the present invention, the old glass panels 17a or plastic films 17 are first removed to expose the underlying rafters 16 or 16b. If the rafter 16b spacing is close, every other rafter 16b is removed to allow more light into the structure. Because of the wider width, e.g., 48 inches, of the rigid, plastic glazing panels 25, every other rafter is usually removed to provide more interior light. The purlin 35 of the present invention may be secured to the top of the existing purlins 14b, as illustrated in FIGS. 23–30 of a former glass panel glazing system, or directly on top of the rafters 16b (FIGS. 2A, and FIGS. 2–4) or rafters 16, as in the Quonset-type greenhouse 15 (FIG. 1B), where there are no purlins. The spaced ends 36 and 37 of aligned purlins are spliced together at locations intermediate the rafters 16 or 16b. Also, the small, lightweight condensation drains 42 are secured to the purlins beneath their ends 36 and 37 to receive condensation 51 discharging from the purlins, as shown in FIGS. 3A, 6 and 18. As best seen in FIGS. 1, 15, 16 and 20, the left-hand side of the greenhouse 15, after conversion, is shown with three or more sets of horizontally-extending purlins 35 that have their respective ends 36 and 37 discharging into a plurality of sets of spaced, bowed drains 42 that carry the condensation downwardly for discharge. In the greenhouse shown in FIG. 1, the glass glazing panels of FIG. 1A have been replaced with the elongated rigid, plastic glazing panels 25 which are fastened to the three (3) horizontal sets of purlins 35. These purlins are connected together by splices 40 (FIGS. 2A, 6 and 7), and these purlins collect condensation and convey and discharge the condensation into the downwardly-sloped drains 42.

By use of these lightweight drains 42 spaced intermediate the rafters in a plane below the top surface 16c of the roof rafters, rather than being secured to the top of the roof rafter surfaces, the purlins 35 need not be raised above the roof rafter surfaces by spacers or the like in order that the condensate discharge downwardly into a lower drain. Thus, the preferred drains 42 are located in a plane below the plane in which the purlins are engaging the top surfaces 16c (FIGS. 2A, 3, 4 and 5) of the rafters.

In accordance with this invention, elongated horizontally extending support members or purlins 35 are utilized to hold in position light transmitting glazing panels 25. The purlins greatly facilitate original construction of a skylight as well as facilitating replacement of glazing panels or more extensive refurbishment of the skylight. The purlins are preferably made of a lightweight material, such as extruded aluminum and come in long lengths, e.g., 16 feet relative to the width of 48 inches of the elongated glazing panels that are very long, e.g., 39 feet in length. By way of example only, the preferred purlins 35 are provided in 16 foot lengths and are spaced vertically along the rafter surfaces at distances of 4 to 5 feet apart. The purlins 35 are secured to the rafters by self-drilling, self-threading fasteners 45 (FIGS. 2, 2A, 3 and 4). The elongated, plastic glazing panels are fastened to each of the purlins 35 by fasteners carrying weather seal washers 46 thereon. Preferably, the elongated plastic, glazing panels are not secured to rafters but only to the horizontal purlins 35.

In one preferred form, the purlins are formed in the shape of an inverted L with an upstanding wall 50 (FIGS. 2, 3 and 7) and top wall 51 which terminates in downwardly depending lip 52. Completing the purlin is a wider bottom wall 53 which extends beyond both sides of upstanding wall 50 with one side being substantially co-terminus with top wall 51. The bottom wall has upstanding flanges 56 and 57 at each side end. These upstanding flanges cooperate with the bottom wall 53 to define channels or conduits for collection and removal of condensate which may form on the interior of the skylight structure. Longitudinally extending grooves 61 and 62 can be provided, respectively, in upstanding wall 50 and bottom wall 53. Planarly aligned, inwardly projecting ribs 63 and 64 can be provided, respectively, on top wall 51 and bottom wall 53. The dimensions of the purlin of this invention are not critical and can be varied, taking into account architectural considerations. As merely illustrative, the bottom wall 53 of a purlin can be 1-⅝ inches in width, the upstanding wall 50 one inch in height and top wall ⅝ inch in width.

Preferably, the purlins 35 are located in alignment end-to-end to extend substantially along the entire horizontal distance of the skylight structure in a direction perpendicular or normal to the rafters 16 or 16b. The condensate removal purlins 35 may be superimposed over existing roof tubular purlins, formerly glass-supporting purlins 14b (FIGS. 23–30) if they are present, as shown in these figures. The vertical spacing between adjacent purlins 35 can be varied, usually 3 to 5 feet with 4 feet being typical.

Each purlin 35 can be provided in a convenient length, say 16 feet, and a desired number of purlins can be planarly aligned and joined by splices 40 to form a span of desired length. This is accomplished by use of splices 40 in the form of plates 68 (FIGS. 3A, 6, 7 and 8) which are rectangular metal plates, say ⅛ inch thick, 1" in width and 5" inches in length. The splice plates 68 are preferably formed of a lightweight metal (FIG. 7) through which a self-tapping screw can be threaded for securing the splice plate to a purlin. For joining two purlins, the splice plates 68 are inserted into the facing ends of two purlins between the upstanding wall 50 and the ribs 63 and 64. The end of the splice plate is secured by self-tapping screws 65 (FIG. 3A) to one of facing ends 36 or 37 of two adjacent purlins. Thus, the other free end of the splice plate is free to slide in its channel with thermal expansion or contraction of the spliced purlins. The joined purlins are spaced one from another by a small space, such as ¼ inch, to permit thermal expansion and contraction and to permit discharge of water from the purlins into the underlying drain 42 (FIG. 3A).

Figure 9:
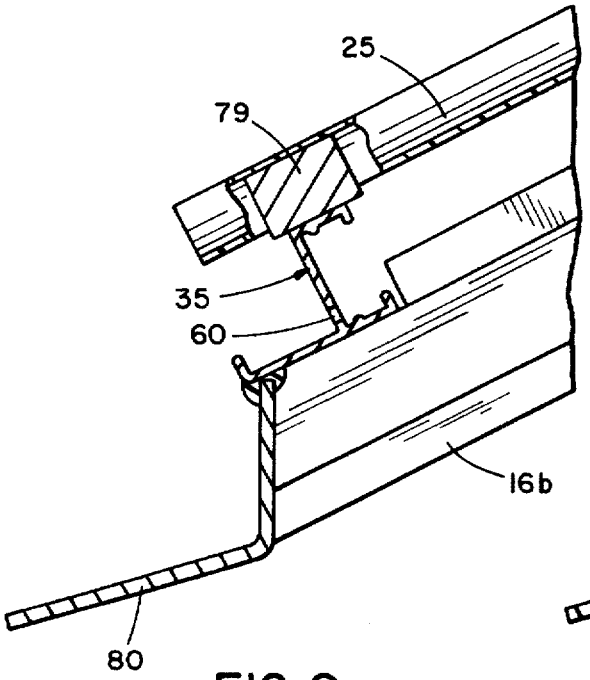
FIG. 9 is a view of a purlin fastened to a roof rafter for discharging moisture through a weep hole into a metal gutter.
Figure 10:
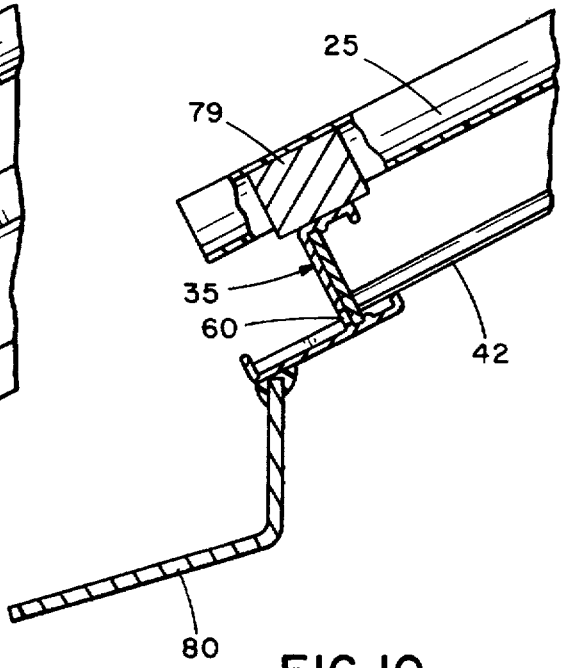
FIG. 10 is a view similar to FIG. 9 illustrating a drain terminating at the purlin and discharging liquid through purlin weep holes to the outside of the greenhouse.
Figure 11:
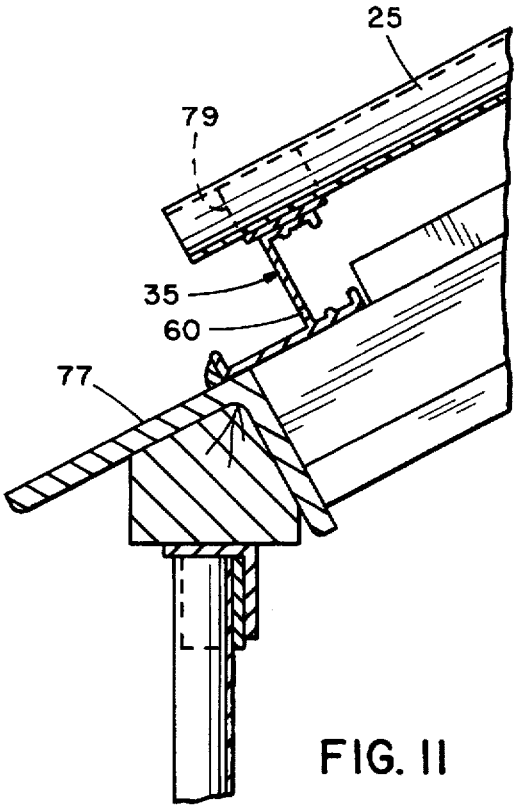
FIG. 11 is a view of a roof rafter supporting a purlin at a steel angle eave.
Figure 12:
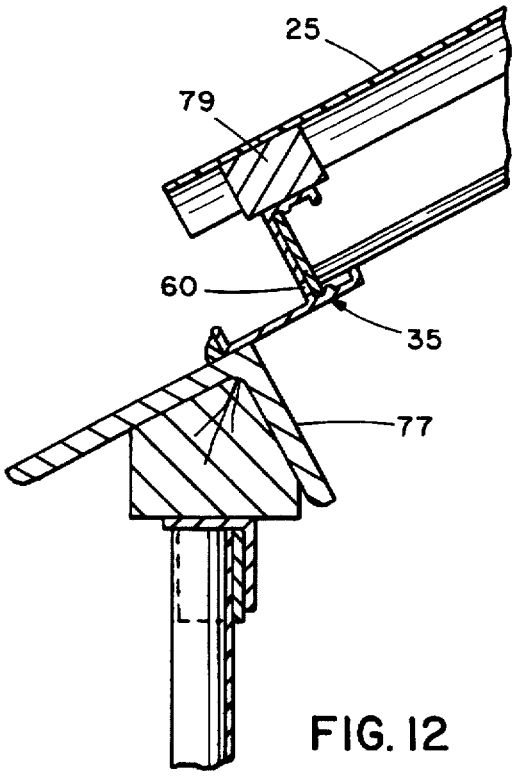
FIG. 12 is a view similar to FIG. 11 showing the drain.

At the joinder of two purlins 35, the drains 42 are provided for directing moisture from the skylight structure which may condense on the interior elements thereof. To this end, a longitudinally extending drain 42 has a cross-section of a slight channel which has a depressed central web 75 (FIGS. 3A and 6), and a pair of upwardly-sloped sidewalls 76 joined at their upper ends to integral attaching flanges 77 that are secured by screws 78 (FIG. 3A) to the spaced facing ends of two joined purlins. The downwardly-sloping drains 42 is formed of lightweight material and extends from the upper purlin of the skylight past the remaining purlins so as to direct collected condensate designated by numeral 51 away from all of the purlins to a drain pipe or eaves 80 (FIGS. 9–12 and 17) on the side of the building which ultimately leads to a sewer or drainage ditch. In FIGS. 10 and 11, drains 42 are shown discharging moisture through weep holes 60 in the bottom purlin 35 for flow to the outside of the greenhouse. In FIG. 9, condensate flows to an outside gutter; and in FIG. 10, condensate flows onto a steel angle eave 77.

The purlins 35 are preferably spliced at a location intermediate the rafters 16b. In some instances, it may be necessary to cut a purlin shorter with a saw to insure that the splice is not located over a rafter. The splices are aligned at the same location vertically on the roof so that respective splice points and drainage from the ends of several of the condensate purlins 35 are all discharging into one long vertical drain 42 which may be made of several pieces attached end-to-end. The drains 42 do not extend up to the top purlin of the roof but only to the next to the top purlin 35, as shown in FIGS. 1, 15, 16, 20 and 22.

In some installations, as illustrated in FIGS. 23-30, where there are no rafters, the condensate purlins 35 are superimposed on the existing roof purlins 14b. If the roof purlins 14b do not exist, such as in new construction or the structures illustrated in FIG. 1B, then the condensate purlins 35 can themselves serve as roof purlin by attachment to the rafters and serving to support the elongated glazing panels 25. The spacing between the horizontal rows of purlins 35 can be varied in accordance with good architectural practice but is usually 4 to 5 feet. Depending upon the longitudinal (horizontal) span of the skylight, a sufficient number of purlins 35 are employed to embrace the length of the span. The purlins 35 can be joined by splicing, as previously described. Underlying the splice point where two purlins are joined in spaced relationship by the splice 44 is drain 42. Moisture condensing on the interior of the skylight structure is collected and conveyed by the bottom wall 53 of the purlins to the drains. The bottom ends of the drains 42 generally extend to an save or into the gutter (FIGS. 9–12 and 17). The drains may also terminate inside the greenhouse at or below the save or gutter. The drain 42 is secured to one facing end of each purlin by screws 78 at the splice point. Drain members are supplied in standard lengths and are cut to length at the job site. On long, high roofs, it may be necessary to use two drains 42 end-to-end. In that instance, the lower end of the upper drain extends over and rests on the upper end of the lower drain piece to transfer water condensate from the upper drain to the lower drain.

BEST AVAILABLE COPY

After the purlins 35 and drain 42 are secured in place on the roof purlins 14b, the rigid, glazing plastic panels 25 are put in place. This is accomplished by laying the panels over the condensate purlins 35. The dimensions of the glazing panels 25 are not critical since the glazing panels can overlap one another both as to width (FIG. 3A) and at various locations in the wide space between adjacent rafters. The glazing panels can also be overlapped in the lengthwise direction. This is a significant advantage in that it eliminates the need for maintaining a large inventory of glazing panels of different sizes and it eliminates the need for cutting the panels to a required size.

Figure 3:
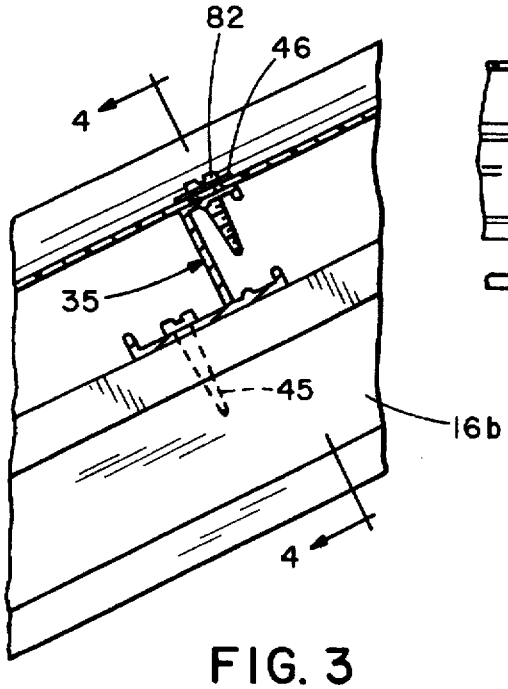
FIG. 3 is a cross-sectional view showing the fastening of a purlin to an existing greenhouse rafter and the fastening of a glazing panel to a purlin.
Figure 4:
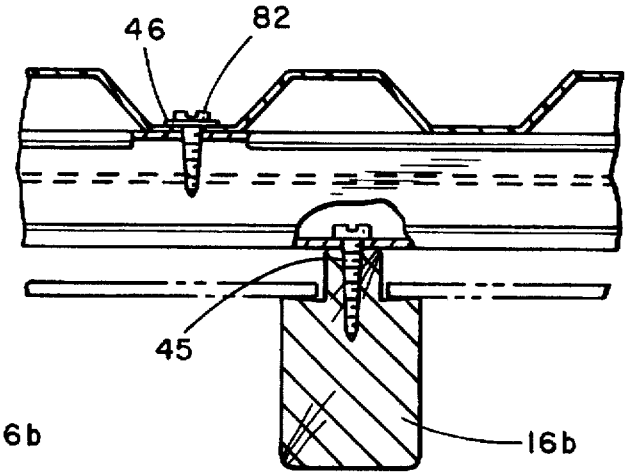
FIG. 4 is a partial cross-sectional view taken substantially along the line 4—4 of FIG. 3.
Figure 3A:
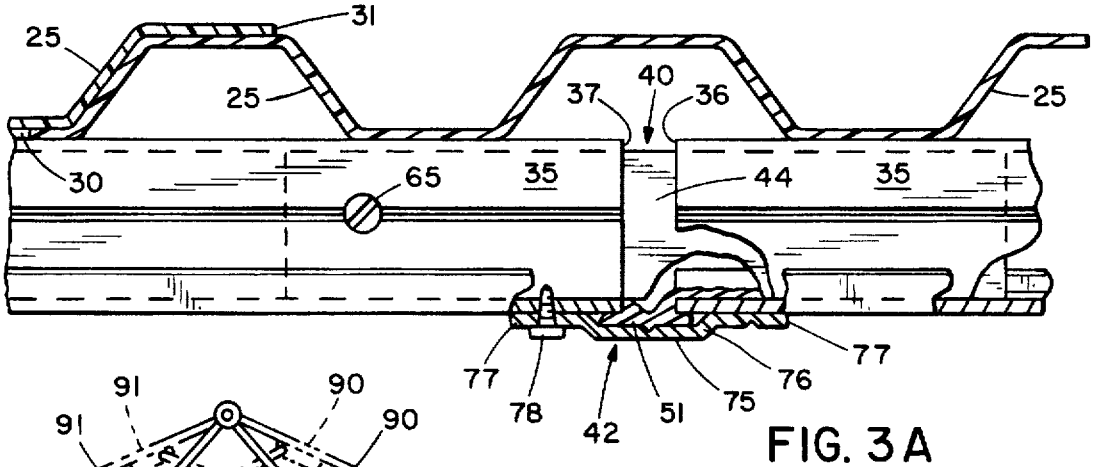
FIG. 3A is a partial cross-sectional view showing adjacent purlins joined by a splice plate and a drain attached to the purlins.
Figure 4A:
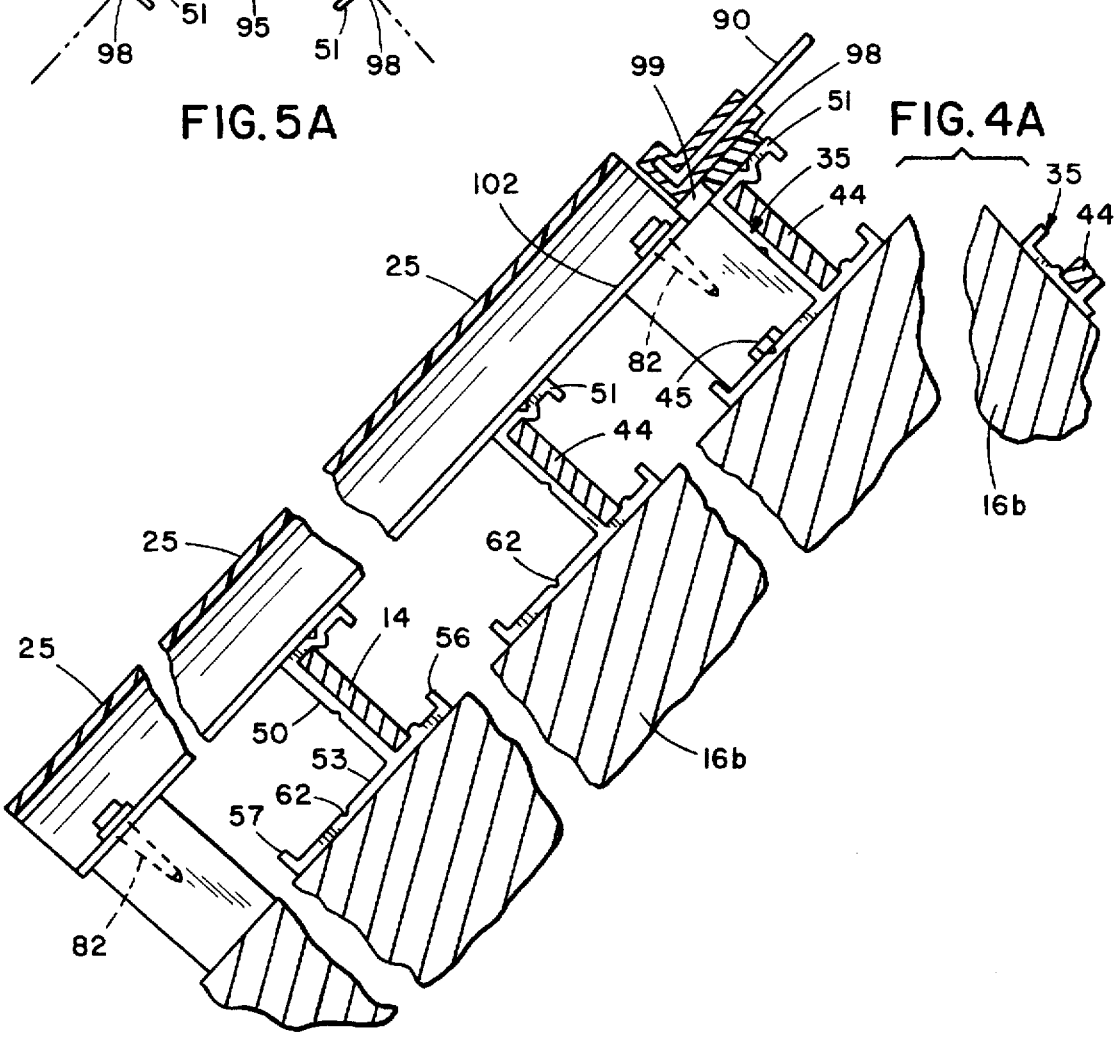
FIG. 4A is a fragmentary cross-sectional view of the skylight structure adjacent a vent.
Figure 5:
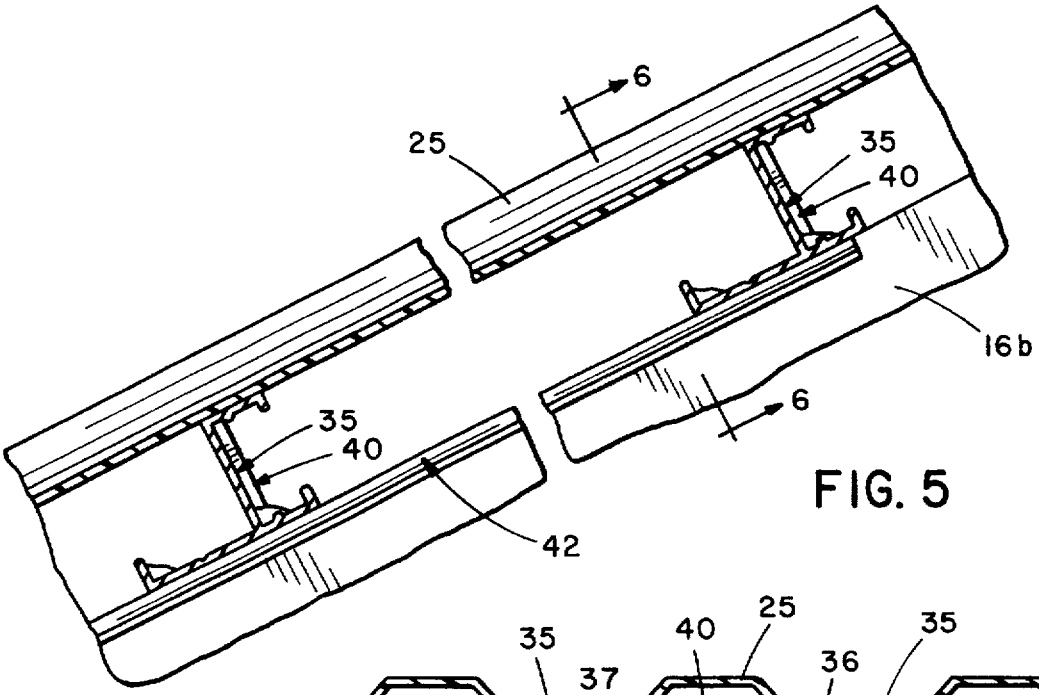
FIG. 5 is a cross-sectional view showing two purlins supporting a glazing panel.

The glazing panels 25 are secured to the underlying purlins 35 in any suitable manner known in the art, such as by self-tapping screws 82 (FIGS. 3, 4 and 4A). At the uppermost purlin 35 (FIG. 2), a corrugated closure strip 79 is positioned in the purlin lower channel and fills the space between the corrugated glazing panel 25 and the purlin to prevent air or moisture from flowing into and through the space now occupied by corrugated closure strip 79. A cap member 84 may be used at the top ridge of the greenhouse, as shown in FIG. 2.

Figure 5A:
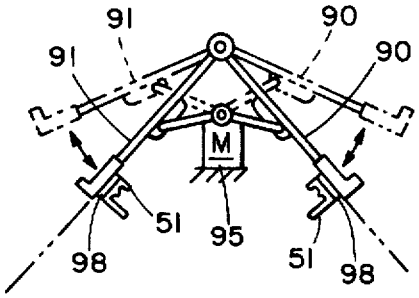
FIG. 5A is a diagrammatic view illustrating a pivotable vent for ventilating purposes.

It is common to include means for permitting air circulation in an enclosure in which a skylight structure is included. For this purpose various vent means are known to the art and a particular vent means is not a feature of the invention. As an illustrative example, vent means 90 is diagrammatically illustrated in FIG. 5A. Such a vent means is usually associated with the main cross-beam at the apex of a structure. The vent means 90 includes two pivotable wings 91 and 92 which pivot to open and closed positions as shown by the arrows in FIG. 5A. A motor 95 controls opening and closing of the pivotable wings 91 and 92 of the vent.

Figure 13:
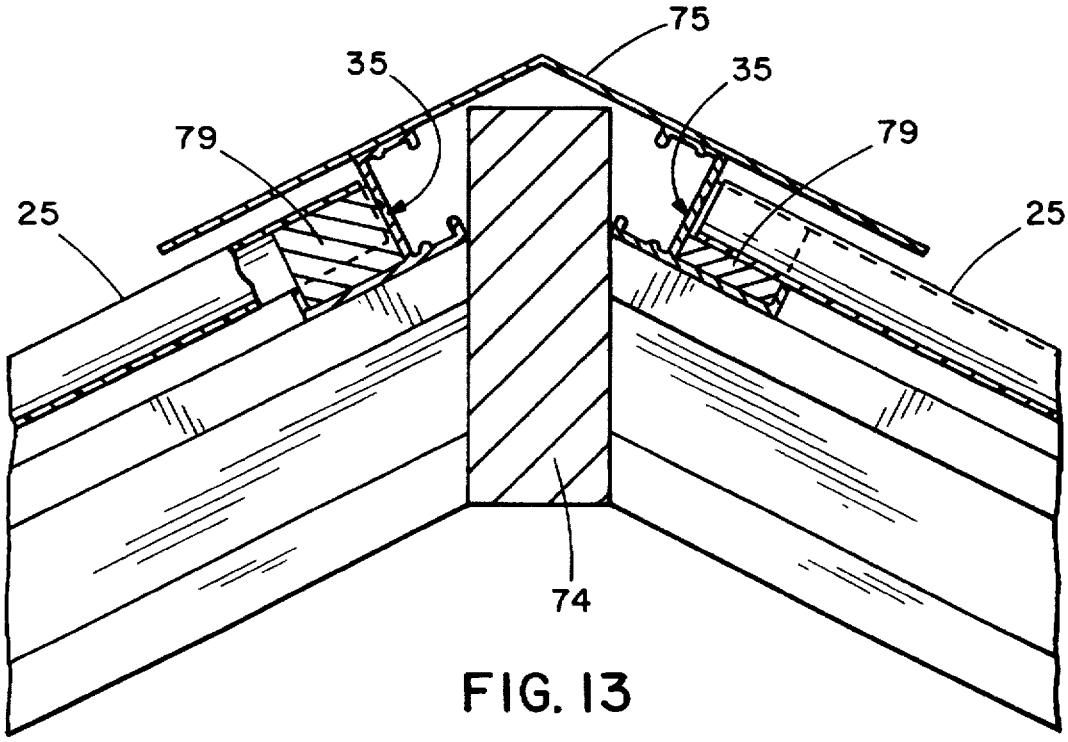
FIG. 13 is a view at the ridge of a greenhouse.
Figure 14:
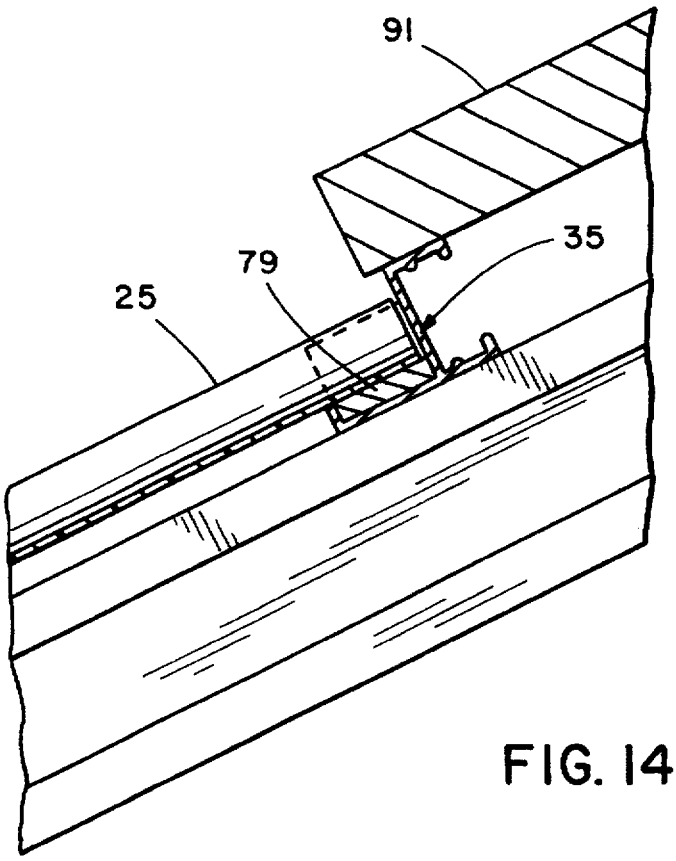
FIG. 14 is a view at a ridge ventilating sashes and header.
Figure 15:
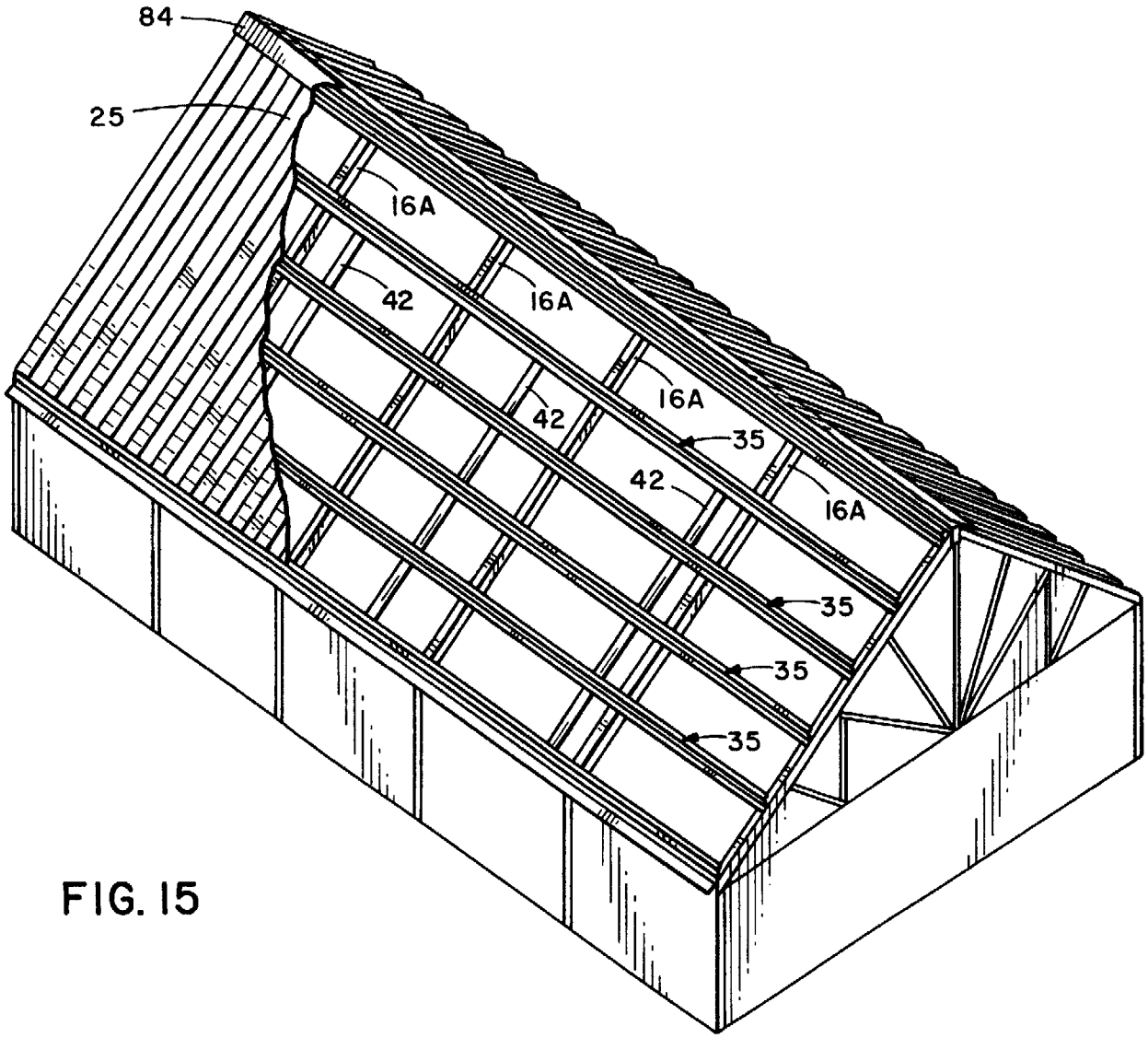
FIG. 15 is a view of a greenhouse without glazing rafters, showing the greenhouse structural frame and embodying the glazing system of the present invention.
Figure 16:
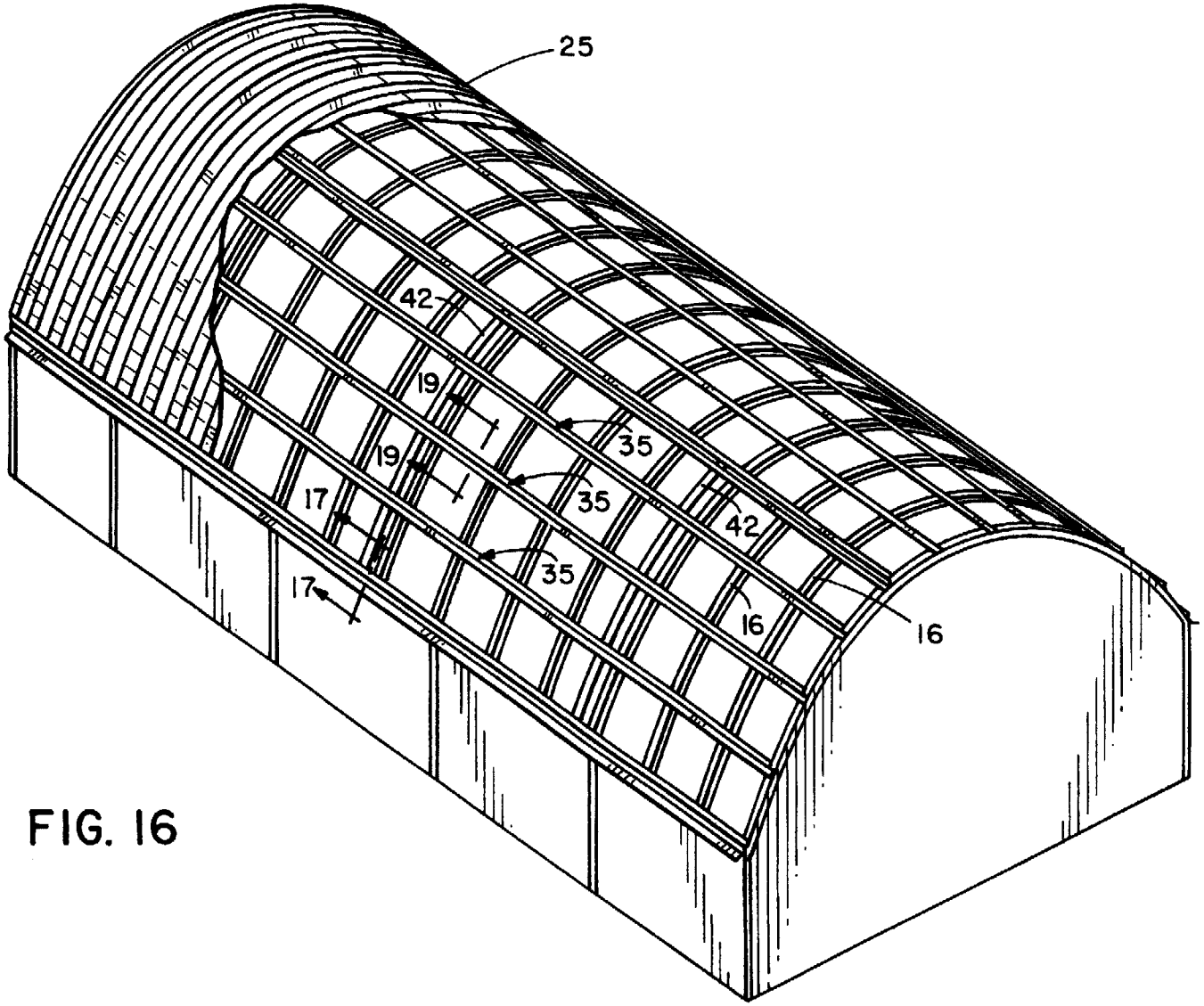
FIG. 16 is a view similar to FIG. 15 with a curved roof.
Figure 17:
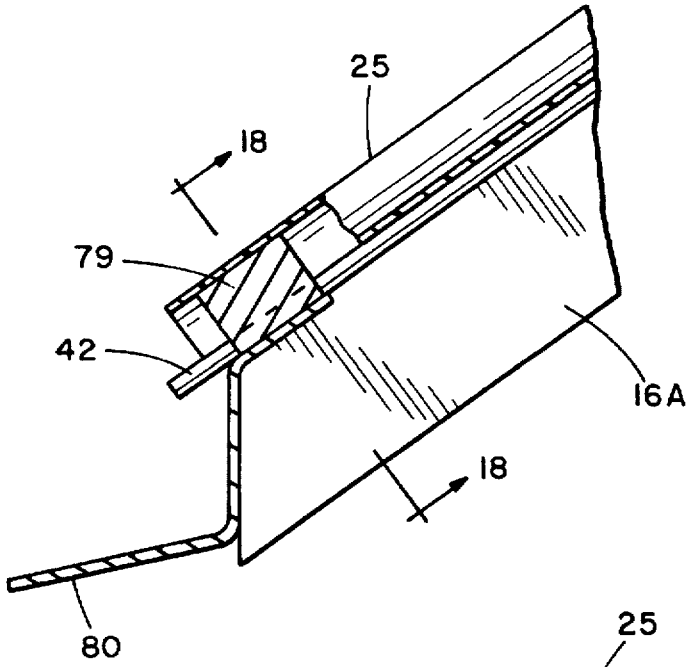
FIG. 17 is a view of a glazing panel supported at a gutter.

As shown in FIG. 4A, the top web 51 of purlin 35 can be positioned to serve as a stop for the pivotable wings 91 and 92. A resilient seal member 98, such as a neoprene strip for a cushioning and sealing effect, can be interposed between the purlin web 51 and underlying end surface 99 on a vent wing 90 or 91. To allow the top flange 51 of the purlin to be available to seal with the underlying end surface 99 of a vent wing, the adjacent end of the rigid, plastic glazing panel is bent downwardly at 101 and 102 (FIG. 4A), and is fastened to the bottom web 53 of the purlin by a self-threading screw 82. This bent end of the glazing panel 25 would normally be resting on the top flange 51 of the purlin, in the manner of the other purlins, as shown in FIG. 4A. Suitable sealant beads of silicone rubber or the like would be used to seal the upper end of the corrugated glazing panel to the adjacent, upstanding purlin wall 50 to prevent air or glass leakage from flowing therebetween. In FIGS. 2 and 13, a pair of purlins 35 may be brought into engagement with a building ridge 74 with a metal cap 75 covering the purlins.

The elongated, glazing panels always extend vertically in the lengthwise direction. In the Quonset-type greenhouse shown in FIG. 20, the glazing panels may extend into the ground by about six inches. The lowest purlin is then usually about six to eighteen inches above grade, and then the purlins 35 are spaced about five feet apart along the roof bow rafters. Self-tapping screws are used to secure the sixteen foot long purlins 35 to a plurality of adjacent roof bow rafters. For maximum strength, it is preferred to splice the purlins 35 adjacent a roof bow rafter than at the mid-point between adjacent rafters. In the Quonset-type greenhouses, the ends of adjacent purlins 35 are spliced, as described above, and the drains 42 are screwed with self-tapping screws from the bottom to the underside of the purlins at the splice locations. The drains 42 are so thin that they are flexible and can be bent to the curved roof contour from their normal, straight, non-curved shaped. The bottom ends of the drains 42 extend only to the bottom purlin 35 and not to grade. The bottom ends of the drains may be run into the purlin to discharge condensation into its horizontal channel. In the case of very long panels, a plurality of aligned glazing panels 25 are overlapped for about 4" to 6" with one panel going over the top of the arch and overlapping the other panel. The laps are made below the upper ridge of greenhouse at the first or second purlin below the ridge.

In accordance with a further embodiment of the invention, illustrated in FIGS. 23–30, the elongated glazing panels 25 and the purlins 35 are attached to roof horizontal purlins 14b, rather than to vertical roof members called roof rafters in the embodiments described above in connection with the embodiments illustrated in FIGS. 1, etc. In the embodiment shown in FIGS. 23–30, the condensate purlins 35 are mounted by spacers 90 above the surfaces of the roof purlins 14b to allow the drains 42 to pass above and to rest on the top of the roof purlins 14b. The spacers 90 may be relatively low in height, such as ⅜", and in shape of small, aluminum channels with their flanges 91 pointed downwardly. Self-drilling and tapping screws 92 are threaded down through the longer flange of the purlin and a central web 93 of the spacer 90 into the roof purlin 14b. The roof purlin may be a metal pipe circular in cross-section, an extruded aluminum four-sided channel, an L-shaped angle bar, a wood beam, etc. Thus, elongated plastic glazing panels 25 are preferably secured only to horizontally extending purlins 35 and there are no rafters used to support the glazing panels 25 in the embodiment of FIGS. 23–30.

Significant advantages of the invention are apparent from the foregoing. Use of the purlins according to the invention generally facilitates original installation or replacement of light-transmitting glass or thin film glazing panels. These glass or thin film glazing panels can be replaced without the necessity of moving rafters or purlins. The condensate collector purlins 35 can be laid on existing roof purlins 14b or they can be used alone as purlin members. The collector purlins 35 can be formed of lightweight material and in desired lengths. Condensate moisture is efficiently conducted by the purlins 35 to a drain. The overlapping of glazing panels between rafters eliminates the need for cutting glazing panels to a precise size to fit rafter spacing or to maintain a large inventory of different size panels.

Those modifications and equivalents which fall within the spirit of the invention are to be considered a part thereof.

What is claimed is:

1. A method of providing a condensation removal system and a converting of an existing skylight structure having existing rafters and existinq glazing materials of thin film sheets, glass panels or the like to rigid plastic panels, said method comprising the steps of:

removing the existing glazing materials from the underlying supporting rafters to expose the same;

laying a plurality of purlins with condensate channels across the existing rafters and extending over the tops of adjacent existing rafters;

bringing ends of adjacent purlins closely adjacent to one another at locations above the existing rafters;

laying on the exposed purlins a series of adjacent, rigid, plastic glazing panels extending across several purlins with the glazing panels being spaced by the purlins above the existing rafters and positioning longitudinal edges of the glazing panels intermediate the rafters; and providing a drain member at a position below the purlins to receive the condensate discharging from the purlins and for conveying away the condensate.

2. A method in accordance with claim 1 including the step of spacing the ends of purlins substantially intermediate a pair of adjacent rafters;

splicing the spaced ends of the purlins together; and securing the drain to the ends of the spliced purlins in a plane located below a plane defined by top surfaces of the rafters.

3. A method in accordance with claim 2 wherein the splicing step comprises fastening a splice member with a fastener to one of the adjacent ends of aligned purlins.

4. A method in accordance with claim 1 including the step of using corrugated, glazing panels and overlapping the longitudinal edges thereof.

5. A method in accordance with claim 4 including the step of bending the glazing panels downwardly at a vent location to allow the vent to close.

6. A method in accordance with claim 1 including the step of removing a plurality of roof rafters to provide more open space prior to installing the purlins.

7. A method in accordance with claim 1 wherein the roof rafters are bowed and including the step of splicing the purlins between adjacent, bowed rafters.

8. A method in accordance with claim 7 including the securing of the drain to the undersides of the purlins with fasteners and installing drains intermediate pairs of adjacent bowed rafters.

9. A method in accordance with claim 1 including the step of exposing purlins previously used to support glass, glazing panels and fastening the plastic glazing purlins onto the glass glazing purlins.

10. A skylight structure having a condensate removal system;

a plurality of spaced rafters inclined downwardly and having upper surfaces;

a plurality of purlins mounted on the upper surfaces of the rafters and projecting upwardly above the upper surfaces of the rafters, the purlins extending laterally of and across adjacent rafters at positions above the rafters;

a plurality of rigid, plastic glazing panels laid on the purlins and supported thereby at positions spaced above the rafters;

the plastic glazing panels being elongated to extend vertically across several purlins and having longitudinally extending edges;

the longitudinally extending edges of adjacent, glazing panels meeting at locations intermediate the rafters;

the purlins having ends positioned intermediate the rafters; and a condensate drain disposed beneath the ends of the purlins and located intermediate adjacent rafters for receiving the condensate discharging therefrom and for carrying away the condensate.

11. A skylight structure in accordance with claim 10 wherein the condensate drain is disposed in a plane beneath a plane defined by the upper surfaces of the rafters.

12. A skylight structure in accordance with claim 10 wherein a splice member is secured to the adjacent ends of the purlins to splice them together at the location, which is intermediate a pair of purlins.

13. A skylight structure in accordance with claim 10 wherein the glazing panels have a corrugated configuration.

14. A method of providing a condensation removal system and a converting of an existing skylight structure having existing underlying roof members and existing glazing materials of thin film sheets, glass panels or the like to elongated rigid, plastic panels, said method comprising the steps of:

removing the existing glazing materials from the underlying supporting roof members to expose the same;

laying a plurality of purlins with condensate channels across and above the underlying existing roof members and securing the purlins to the roof members;

bringing ends of adjacent purlins closely adjacent to one another;

laying on the exposed purlins a series of adjacent, elongated, rigid, plastic glazing panels having a vertical length longer than the distance between adjacent purlins and laying the glazing panels with their longitudinal edges extending vertically across a plurality of underlying purlins;

overlapping marginal edges of adjacent glazing panels;

securing the elongated, glazing panels to the purlins at positions above the underlying roof member; and providing drains at positions below the purlins to receive the condensate discharging from the purlins and for conveying away the condensate.

15. A method in accordance with claim 14 including the step of spacing the ends of purlins substantially intermediate a pair of adjacent rafter roof members;

splicing the spaced ends of the purlins together; and securing the drain to the ends of the spliced purlins in a plane located below a plane defined by top surfaces of the rafter roof members.

16. A method in accordance with claim 15 wherein the splicing step comprises fastening a plate with a fastener to one of the adjacent ends of aligned purlins.

17. A method in accordance with claim 16 including the steps of:

placing a spacer between roof purlin members and the purlins; and placing the drain members on top of the purlin roof members.

* * * * *